US007614096B2

(12) United States Patent
Vincent

(10) Patent No.: US 7,614,096 B2
(45) Date of Patent: Nov. 10, 2009

(54) CONTROL FOR AN AUTOMATIC PLUMBING DEVICE

(75) Inventor: Raymond A. Vincent, Plymouth, MI (US)

(73) Assignee: Masco Corporation of Indiana, Indianapolis, IN (US)

( * ) Notice: Subject to any disclaimer, the term of this patent is extended or adjusted under 35 U.S.C. 154(b) by 378 days.

(21) Appl. No.: 11/081,457

(22) Filed: Mar. 16, 2005

(65) Prior Publication Data

US 2006/0207019 A1 Sep. 21, 2006

(51) Int. Cl.
*E03C 1/05* (2006.01)

(52) U.S. Cl. ..... 4/623

(58) Field of Classification Search ..... 4/623, 4/DIG. 3, 302, 304, 313; 137/554; 251/129.04; 250/221

See application file for complete search history.

(56) References Cited

U.S. PATENT DOCUMENTS 5,025,516 A * 6/1991 Wilson ..... 4/623
5,549,273 A * 8/1996 Aharon ..... 251/129.04
5,819,336 A * 10/1998 Gilliam et al. ..... 4/623
6,192,530 B1 * 2/2001 Dai ..... 4/623
6,598,245 B2 * 7/2003 Nishioka ..... 4/623
6,671,890 B2 * 1/2004 Nishioka ..... 4/304
6,770,869 B2 * 8/2004 Patterson et al. ..... 4/623
7,104,519 B2 * 9/2006 O'Maley et al. ..... 251/129.04
7,107,631 B2 * 9/2006 Lang et al. ..... 4/623

FOREIGN PATENT DOCUMENTS

DE 3100773 A1 * 11/1981
EP 0623710 A1 * 5/1993

* cited by examiner

*Primary Examiner*—Huyen Le
(74) *Attorney, Agent, or Firm*—Baker & Daniels LLP

(57) ABSTRACT

A plumbing device uses electronic control circuitry with two infrared emitters and one infrared receiver to detect objects in a particular region of space. In one embodiment, detection of an object using both sensors (in sequential scans) results in the plumbing device turning on. When no object has been detected for a certain amount of time, the plumbing device is turned off. Also, when the plumbing device has run for another certain amount of time, the plumbing device is turned off regardless of whether an object is still being detected. In another embodiment, the output of the IR emitters is partially blocked by one or more mask elements to tailor the region that is covered by both IR emitters and, hence, the region that triggers the opening of the plumbing device valve.

20 Claims, 4 Drawing Sheets

CONTROL FOR AN AUTOMATIC PLUMBING DEVICE

BACKGROUND OF THE INVENTION

The present invention relates controls for plumbing devices, and more particularly to plumbing devices automatically triggered by infrared-based object detection.

Object detection systems that use infrared (IR) signals to trigger plumbing device operation, such as operation of an automatic faucet, are known. Typically, these systems utilize a single IR emitter and an IR detector to control fluid flow based upon object detection within a defined region. A control activates the IR emitter and then monitors the IR detector for reflections of infrared light from objects (such as a user's hands) that are sensed and used to determine whether to activate or deactivate a solenoid valve.

The object detection systems are typically designed and implemented integral to the plumbing device. Disadvantageously, this may result in the failure of the plumbing device to trigger operation until the user's hand is directly under the faucet. The object detection systems also are prone to false triggering as a result of unwanted reflections off of surrounding objects, such as a sink, or off the water stream itself. If the reflection off the water stream is not avoided, the solenoid valve may become locked-on, thus resulting in a waste of water and annoyance to the user.

Accordingly, it is desirable to provide an improved automatic plumbing device that provides a more tailored detection area and reduces false triggering caused by reflections.

SUMMARY OF THE INVENTION

An automatic plumbing device according to the present invention provides improved object detection in a desired volume.

The automatic plumbing device of the present invention includes a first IR emitter, a second IR emitter and an IR receiver mounted within a plumbing body. The two IR emitters and the IR receiver are configured so that objects in a sensitivity volume are detected. A controller manages the detection process and controls the operation of the IR emitters in sequence to yield emissions within a first region of sensitivity and a second region of sensitivity. Based on emitted returns received through the IR receiver from the first region of sensitivity and the second region of sensitivity, the controller opens or closes a valve using a solenoid control. In some forms of the invention, the first region of sensitivity and the second region of sensitivity are more narrowly tailored by a first and second mask.

Delay circuitry may allow water to flow for a period of time after the last object is detected, and limits the total length of time that water can constantly run. A voltage regulator and low battery detector detects whether the power being supplied to the circuit is adequate (e.g., above a certain threshold voltage).

The invention may be used as part of a faucet, although other plumbing applications are within the scope of this invention.

The automatic plumbing device according to the present invention provides a more tailored detection region and reduces false triggering of the device caused by reflections.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
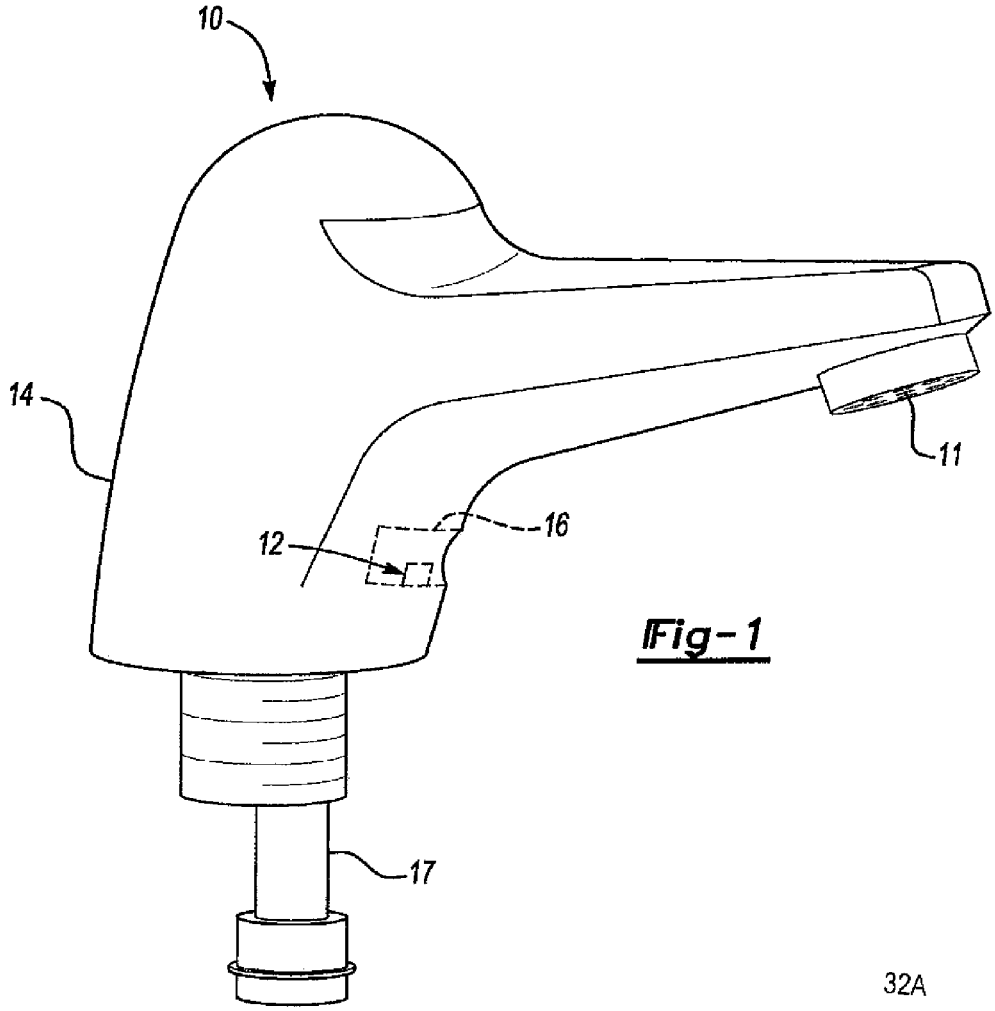
FIG. 1 is a perspective view of a water faucet incorporating an object detection system according to the present invention.

Referring to FIG. 1, a water faucet 10 adapted with an object detection system 12 according to the present invention is illustrated. Although the object detection system 12 is shown and described in terms of a water faucet 10, it should be understood that other plumbing devices, including but not limited to toilets and showers, may employ the configuration disclosed herein.

The water faucet 10 defines a spout section 11 and a base section 14. The base section 14 includes a housing 16 for housing the object detection system 12 of the present invention. A pipe 17 communicates a liquid, such as water, through the base section 14 to the spout section 11 where the water exits the water faucet 10.

Figure 2:
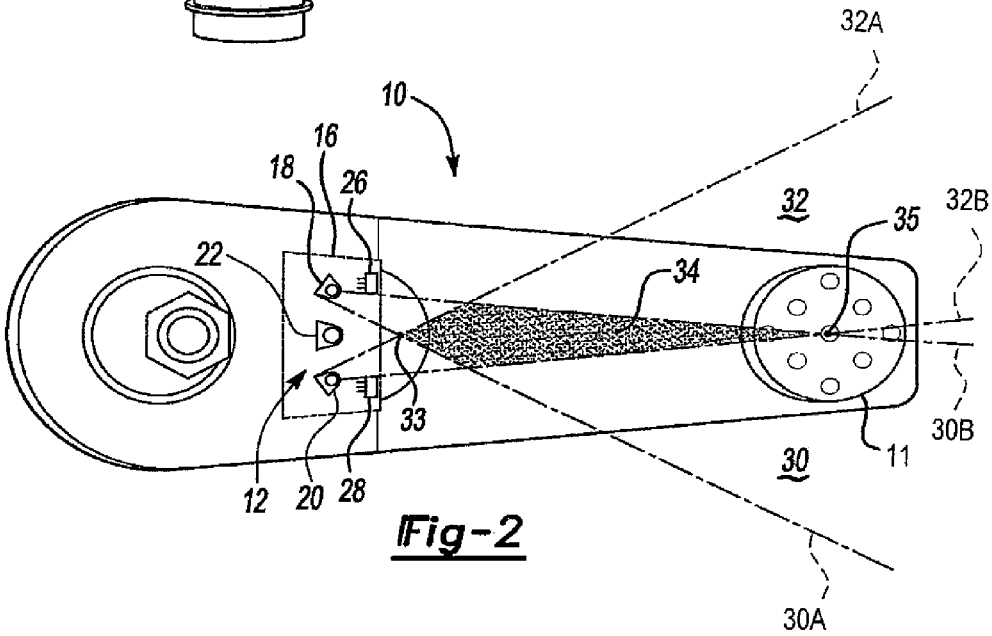
FIG. 2 is a plan view of the detection fields of emitters configured according to one embodiment of the present invention.

Referring to FIG. 2, the configuration of the object detection system 12 within the housing 16 of the water faucet 10 is illustrated. The housing 16 houses an IR emitter 18 (on the top as shown in FIG. 2), an IR emitter 20 (on the bottom), and an IR receiver 22 (in the center) as shown. Each IR emitter 18 and 20 is oriented so its region of sensitivity is limited by a mask (26 and 28, respectively). These masks limit the zones of sensitivity of the IR emitter 18 and the IR emitter 20 to a first region of sensitivity 30 and a second region of sensitivity 32, respectively. An overlap of the first region of sensitivity 30 and the second region of sensitivity 32 defines a sensitivity volume 34 having a starting point 33 and an endpoint 35. As shown in FIG. 2, the IR emitters 18, 20 are oriented towards each other such that the first region of sensitivity 30 and the second region of sensitivity 32 intersect at the starting point 33 and diverge at the endpoint 35. More particularly, the first region of sensitivity 30 includes an inner boundary 30A and a diverging outer boundary 30B, while the second region of sensitivity 32 includes an inner boundary 32A and a diverging outer boundary 32B. The intersection of the inner boundaries 30A and 32A define the starting point 33 of the sensitivity volume 34. Likewise, the intersection of the outer boundaries 30B and 32B define the endpoint 35 of the sensitivity volume 34. As shown in FIG. 2, a first portion of the sensitivity volume 34 is defined by the inner boundaries 30A and 32A, while a second portion of the sensitivity volume 34 is defined by the outer boundaries 30B and 32B. The sensitivity volume 34 is the region on which objects will be detected as described below. It can be seen from FIG. 2 that the location, shape, and size of the sensitivity volume 34 can be modified by manipulating the location and orientation of the IR emitters 18 and 20, the IR receiver 22, and the masks 26 and 28, as would occur to one skilled in the art. As shown in FIGS. 1 and 2, the IR emitters 18, 20 in this example are disposed in substantially the same horizontal plane.

Figure 3:
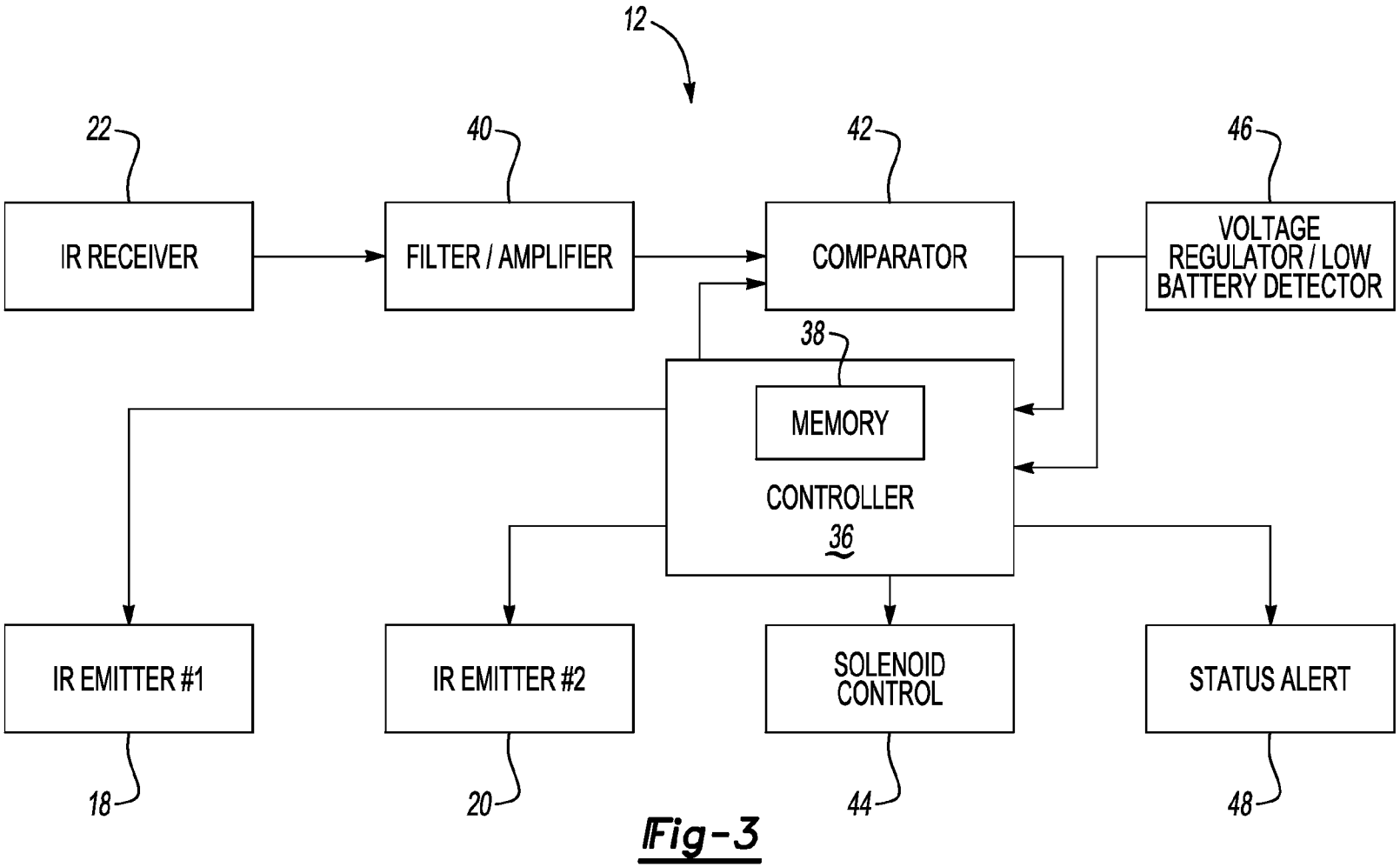
FIG. 3 is a block diagram of the object detection system according to the present invention.

Referring to FIG. 3, using logic to apply a method that will be described below, a controller 36 communicates with a memory 38 that contains instructions executable by the controller 36 to perform the control process. The controller 36 may be of any suitable microcontroller, microprocessor, computer or the like that would occur to one skilled in the art. The memory 38 may include a hard drive, CD-ROM, DVD, RAM, ROM or other optically readable storage, magnetic storage, or integrated circuit.

The controller 36 selectively and periodically activates the IR emitter 18 and the IR emitter 20 to cause returns to be received at the IR receiver 22. The levels of these returns vary depending on whether an object is present within the sensitivity volume 34. A filter/amplifier 40 conditions the signal from the IR receiver 22 and provides it to a comparator 42. The comparator 42 compares the filtered and amplified signal from the filter/amplifier 40 to a threshold provided by the controller 36 to provide a comparison output to controller 36. The controller 36 applies the logic and method described below to actuate a solenoid control 44, which turns the associated plumbing device on and off when appropriate. Power to the controller 36, such as by one or more dry cells (not shown), is monitored by a voltage regulator/low battery detector 46. If the voltage regulator/low battery detector 46 indicates a power problem, or if another error condition is indicated, the controller 36 activates a status alert 48 to notify a user or maintenance worker of the problem.

Figure 4:
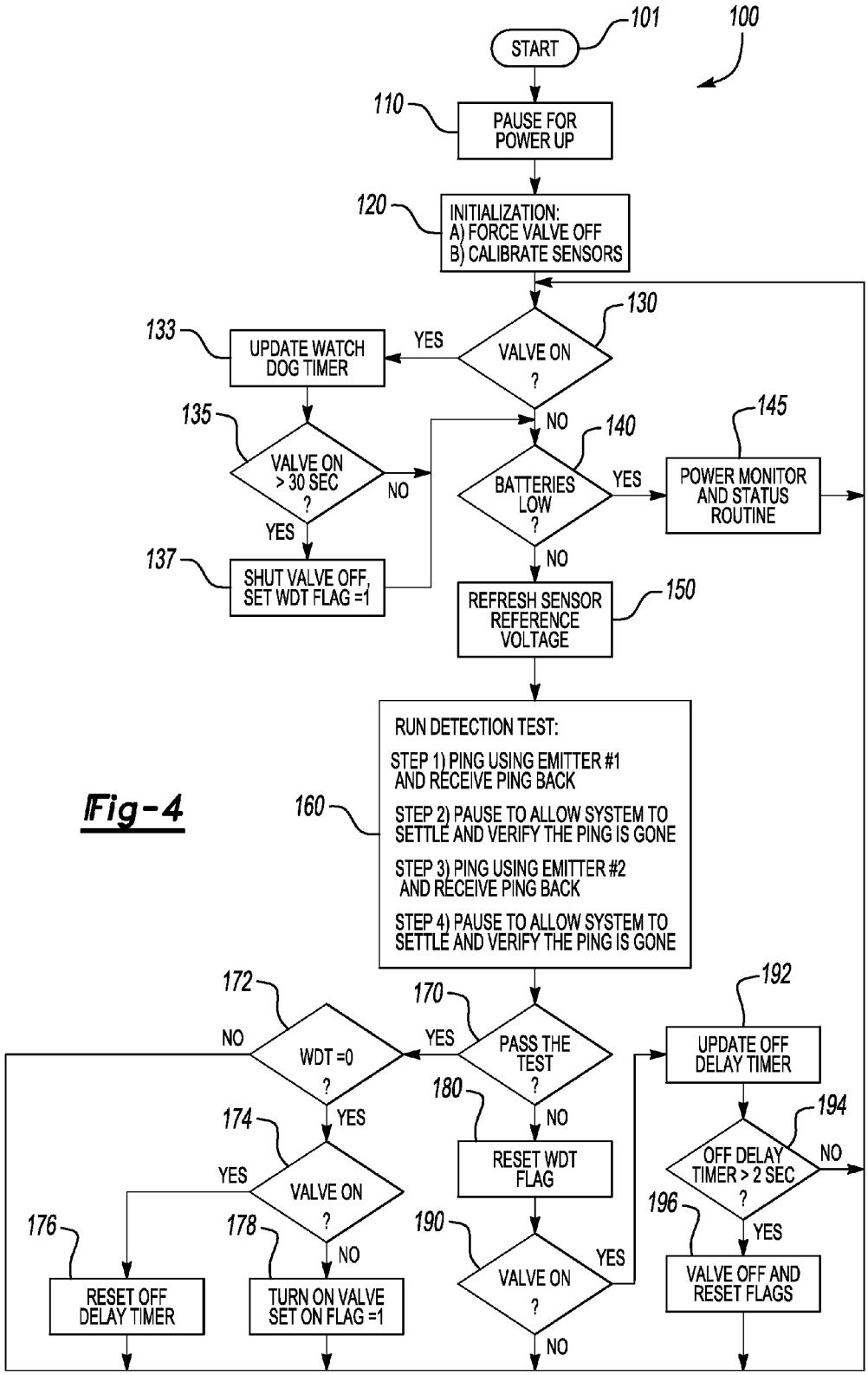
FIG. 4 is a flow chart describing the logical progression of tests and events in one embodiment of the present invention.

Referring to FIG. 4, with continuing reference to FIGS. 1, 2 and 3, the operation of the object detection system 12 will now be discussed. Procedure 100 begins at start point 101 when power is applied to the system. The controller 36 waits at block 110 while power is established and stabilized. The system initializes at block 120 by forcing the solenoid control 44 to an "off" position and calibrating the IR emitters 18 and 20, the IR receiver 22, the filter/amplifier 40, and the threshold value provided by the controller 36 to the comparator 42, as would be understood by those skilled in the art.

The system determines at decision block 130 whether a faucet valve is in an "on" position. If so, a watchdog timer (implemented using the controller 36 or other means as would occur to one skilled in the art) is updated at block 133. If the updated watchdog timer reflects that the faucet valve has been on more than a predetermined amount of time (thirty seconds, for example), as determined at decision block 135, the microcontroller 36 closes the faucet valve using the solenoid control 44 and sets the watch dog timer ("WDT") flag, these steps being combined at block 137. Then, or following a negative result at block 135, or upon a negative result of block 130, the system proceeds to decision block 140.

At decision block 140, the controller 36 checks its input from the voltage regulator/low battery detector 46 to determine whether the power supply is low. If so, the controller 36 executes a power monitor and status routine at block 145 and returns to decision block 130. This routine determines whether to initiate low-power-consumption measures; set an audio, visual, or other alarm; and/or take other action as would occur to one skilled in the art.

Upon a negative result at decision block 140, the controller 36 refreshes the sensor reference voltage at block 150 using one or more techniques that would occur to one skilled in the art. The controller 36 then runs a detection test at block 160. In doing so, the elements of system 100 cooperate to "ping" the faucet environment using the IR emitter 18 and receive the result using the IR receiver 22. The controller 36 then pauses to allow the system to settle and verify that the IR return being received has returned to a nominal level. The system then emits a ping using the IR emitter 20 and reads the return using the IR receiver 22, then pauses to allow the system to settle again and verify once more that the IR return has dropped to a nominal level.

Then, at decision block 170, the system evaluates whether an object has been detected in the sensitivity volume 34 by comparing the returns received at the IR receiver 22 during the detection test at decision block 160 to a threshold value provided by the controller 36. The threshold value is a stored return level value representing what the return level value would be (plus or minus a range of error) in the event an object, such as a hand, is within the sensitivity volume 34. The threshold value must be detected during the first ping and the second ping of the detection test at decision block 160 before the controller 36 recognizes an object within the sensitivity volume 34. If an object has been detected at decision block 170, the system determines at decision block 172 whether the WDT flag is set. After a negative result at decision block 172, the system returns to decision block 130.

If the result of decision block 172 is positive (i.e., the WDT flag is reset), the system determines (using the solenoid control 44 or an internal copy of its state) whether the faucet valve is in an "on" position. If so, the "off delay timer" is reset at block 176, and the system returns to decision block 130. If, however, the result of decision block 174 is negative (i.e., the faucet valve is off), the system turns on the faucet valve and sets the ON flag at block 178. The system then returns to decision block 130.

If there is a negative result at decision block 170 (i.e., one or both pings at decision block 160 produced negative results), the WDT flag is reset at block 180. The system then tests the ON flag to determine at block 190 whether the faucet valve is on. If not, the system returns to decision block 130.

If the faucet valve is on (i.e., there is a positive result at decision block 190), the off delay timer is updated at block 192. The off delay timer is tested at decision block 194 to determine whether it reflects a period greater than a predetermined length of time (e.g., two seconds). If the time is less than the predetermined amount (negative result at block 194), the system returns to decision block 130. Otherwise (positive result at block 194) the faucet valve is turned off and the flags are reset at block 196, then the system returns to decision block 130.

Figure 5:
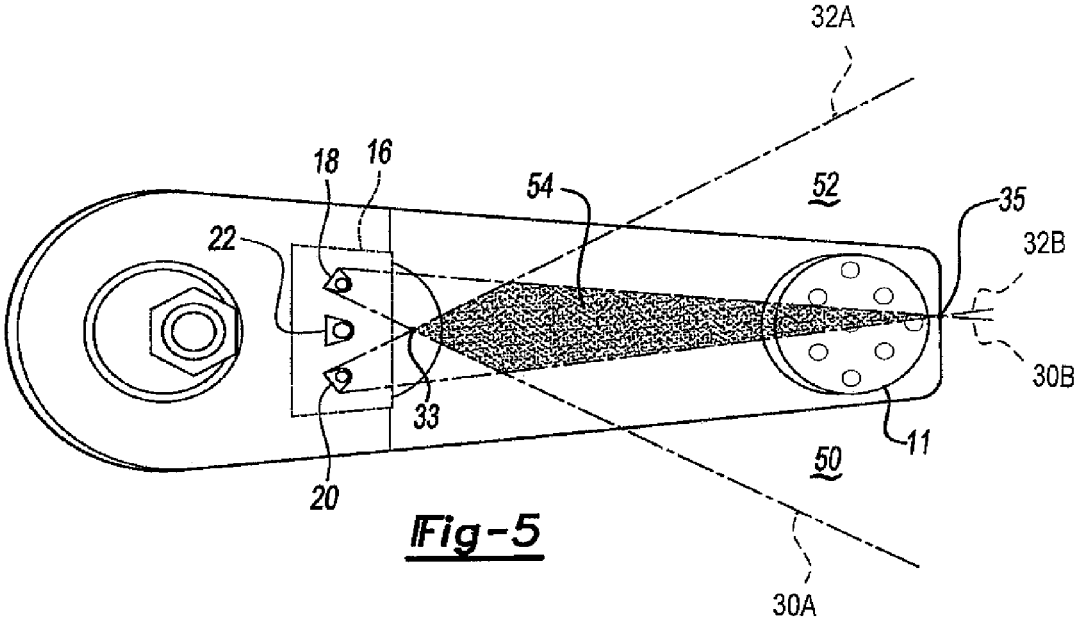
FIG. 5 is a plan view of the detection fields of emitters configured according to a second embodiment of the present invention.

An alternative embodiment of the present invention is shown in FIG. 5. Here, the IR emitter 18, the IR emitter 20, and the IR receiver 22 are positioned and oriented in much the same way as in the embodiment shown in FIG. 2. In this alternative embodiment, however, no masks are used to shape the emissions from the IR emitters 18 and 20. Instead, the positioning and orientation of those components are more precisely tailored to yield a first region of sensitivity 50 and a second region of sensitivity 52. The overlap of the first region of sensitivity 50 and the second region of sensitivity 52 defines a sensitivity volume 54. The same logic and method can be used to control this embodiment as was described in relation to FIGS. 3 and 4.

While IR emitters have been disclosed, other emitters capable of creating a deflected signal may be utilized within this invention.

That the foregoing description shall be interpreted as illustrative and not in a limiting sense is thus made apparent. A worker of ordinary skill in the art would recognize that certain modifications would come within the scope of this invention. For that reason, the following claim should be studied to determine the true scope and content of this invention.

What is claimed is:

1. An automatic plumbing device, comprising:

a plumbing body;

a first emitter oriented to yield emissions in a first region of sensitivity including an inner boundary and an outer boundary diverging from the inner boundary;

a second emitter oriented to yield emissions in a second region of sensitivity that intersects the first region of sensitivity, the second region including an inner boundary and an outer boundary diverging from the inner boundary, wherein the first region of sensitivity and the second region of sensitivity overlap to form a sensitivity volume, and wherein a starting point of the sensitivity volume is defined by the intersection of the inner boundary of the first region of sensitivity and the inner boundary of the second region of sensitivity, and an end point of the sensitivity volume is defined by the intersection of the outer boundary of the first region of sensitivity and the outer boundary of the second region of sensitivity, and the first region of sensitivity and the second region of sensitivity diverge at the end point where the sensitivity volume ends;

a receiver adapted to receive emitted returns from said first region of sensitivity and said second region of sensitivity and to detect an object in the sensitivity volume by comparing the emitted returns to a threshold value; and a controller in communication with said receiver and said first emitter and said second emitter, said controller operable to open a valve in response to an object detected in the sensitivity volume, and to close the valve in response to a timer or in response to no object being detected in the sensitivity volume.

2. The automatic plumbing device as described in claim 1, wherein said plumbing body is a faucet having a spout section.

3. The automatic plumbing device as described in claim 2, wherein the sensitivity volume extends between the spout section and a housing enclosing the first emitter, the second emitter, and the receiver.

4. The automatic plumbing device as described in claim 2, wherein the first region of sensitivity and the second region of sensitivity diverge past the spout section.

5. The automatic plumbing device as described in claim 1, further comprising a first mask mounted on said plumbing body.

6. The automatic plumbing device as described in claim 5, wherein said emissions of said first emitter are at least partially blocked by said first mask to define said first region of sensitivity.

7. The automatic plumbing device as described in claim 6, further comprising a second mask mounted on said plumbing body.

8. The automatic plumbing device as described in claim 7, wherein said emissions of said second emitter are at least partially blocked by said second mask to define said second region of sensitivity.

9. The automatic plumbing device as described in claim 1, wherein said first emitter and said second emitter yield said emissions in response to instructions received from said controller.

10. The automatic plumbing device as described in claim 1, wherein said controller communicates with a memory device containing instructions executable by said controller to open and close said valve.

11. The automatic plumbing device as described in claim 1, further comprising a solenoid control, said controller communicating with said solenoid control to open and close said valve.

12. The automatic plumbing device as described in claim 1, wherein said first emitter and said second emitter are infrared emitters.

13. The device of claim 1, wherein the first emitter and the second emitter are disposed in substantially a same horizontal plane.

14. An automatic plumbing device, comprising:

a plumbing body having a valve;

a first emitter oriented to yield emissions in a first region of sensitivity including an inner boundary and an outer boundary diverging from the inner boundary;

a second emitter oriented to yield emissions that form a second region of sensitivity, the second region including an inner boundary and an outer boundary diverging from the inner boundary, wherein a portion of the first region of sensitivity and a portion of the second region of sensitivity overlap to form a defined sensitivity volume and wherein a starting point of the sensitivity volume is defined by the intersection of the inner boundary of the first region of sensitivity and the inner boundary of the second region of sensitivity, and an end point of the sensitivity volume is defined by the intersection of the outer boundary of the first region of sensitivity and the outer boundary of the second region of sensitivity, and the first region of sensitivity and the second region of sensitivity diverge at the end point where the sensitivity volume ends;

a receiver adapted to receive emitted returns from said first region of sensitivity and said second region of sensitivity and to detect an object in the sensitivity volume by comparing the emitted returns to a threshold value; and a controller in communication with said receiver and said first emitter and said second emitter, said controller operable to open the valve in response to an object detected in the sensitivity volume, and operable to close the valve in response to no object being detected in the sensitivity volume.

15. The device of claim 14, wherein the first emitter and the second emitter are disposed in substantially a same horizontal plane.

16. The device of claim 14, wherein the first emitter and the second emitter are oriented toward each other to form the defined sensitivity volume.

17. The device of claim 14, wherein the defined sensitivity volume has a starting point and an endpoint.

18. The device of claim 14, wherein the controller is also operable to close the valve in response to a timer.

19. The device of claim 14, further comprising a first mask mounted on the plumbing body, and a second mask mounted on the plumbing body, wherein said emissions of said first emitter are at least partially blocked by said first mask to define said first region of sensitivity, and wherein said emissions of said second emitter are at least partially blocked by said second mask to define said second region of sensitivity.

20. The device of claim 14, wherein the plumbing body is a faucet having a spout section, and wherein fluid emitted from the spout section flows across said endpoint.

* * * * *

UNITED STATES PATENT AND TRADEMARK OFFICE

CERTIFICATE OF CORRECTION

PATENT NO. : 7,614,096 B2
APPLICATION NO. : 11/081457
DATED : November 10, 2009
INVENTOR(S) : Raymond A. Vincent It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 532 days.

Signed and Sealed this

Nineteenth Day of October, 2010

David J. Kappos

David J. Kappos
*Director of the United States Patent and Trademark Office*